US006647673B2

(12) United States Patent
Smerud

(10) Patent No.: US 6,647,673 B2
(45) Date of Patent: Nov. 18, 2003

(54) STANDARDIZED ARCHED JAMB ASSEMBLY AND METHOD

(76) Inventor: Richard J. Smerud, 3667 Camino Marglesa, Escondido, CA (US) 92025

( * ) Notice: Subject to any disclaimer, the term of this patent is extended or adjusted under 35 U.S.C. 154(b) by 53 days.

(21) Appl. No.: 09/954,683

(22) Filed: Sep. 11, 2001

(65) Prior Publication Data

US 2003/0046881 A1 Mar. 13, 2003

(51) Int. Cl.[7] ..... E04B 1/32
(52) U.S. Cl. ..... 52/88; 52/204.1; 52/210
(58) Field of Search ..... 52/86, 88, 204.1, 52/204.2, 210, 245, 329

(56) References Cited

U.S. PATENT DOCUMENTS

| | | | | | |
|---|---|---|---|---|---|
| 391,463 | A | * | 10/1888 | Ellis | 14/24 |
| 1,074,268 | A | * | 9/1913 | Kelly et al. | 52/88 |
| 1,985,599 | A | * | 12/1934 | Cates et al. | 52/643 |
| 2,360,285 | A | | 10/1944 | Sherman | |
| 3,130,488 | A | | 4/1964 | Lindstrom | |
| 3,164,928 | A | | 1/1965 | Sarros | |
| 4,955,168 | A | * | 9/1990 | Barry | 52/210 |
| 5,245,802 | A | * | 9/1993 | Davis | 52/86 |
| 5,584,148 | A | * | 12/1996 | Barry et al. | 52/86 |
| 6,128,864 | A | | 10/2000 | Barry et al. | |
| 6,401,405 | B1 | * | 6/2002 | Hicks | 52/88 |

* cited by examiner

*Primary Examiner*—Brian E. Glessner
(74) *Attorney, Agent, or Firm*—Brown, Martin, Haller & McClain LLP

(57) ABSTRACT

A standardized arched jamb assembly includes an arched jamb member and a pair of opposite upright jamb members with angled cuts made at opposite ends of the arched jamb member and upper end portions of the upright jamb members where the arched jamb member meets and interfaces with the upright jamb members to form the arched jamb assembly. The angled cuts are two-sided and have substantially the same standard angular configurations, irrespective of variations in the radii of curvature of upper arched jamb members used with upright jamb members to provide wall openings of different widths. The two-sided angled cuts are preferably standard right-angled notches and end cuts.

12 Claims, 2 Drawing Sheets

STANDARDIZED ARCHED JAMB ASSEMBLY AND METHOD

BACKGROUND OF THE INVENTION

1. Field of the Invention

The present invention generally relates to an arched jamb for providing arched wall openings, such as doorways, windows and the like, and, more particularly, is concerned with a standardized arched jamb assembly and method.

2. Description of the Prior Art

Arched jambs provide arched wall openings, such as doorways, in homes. Arched jambs generally cost more than conventional rectangular jambs but they dramatically enhance the aesthetic appeal and thus the market value of homes.

Prior art arched jambs typically have an upper arched jamb member which defines the top of the arched wall opening and a pair of upright jamb members which define the opposite sides of the wall opening. The upright jamb members have upper end portions which support the upper arched jamb member at its opposite ends. For aesthetic reasons, the upper arched jamb member is typically positioned at a standard height above the floor no matter what the width of the wall opening is between the upright jamb members. Thus, as the width of the wall opening or distance between the upright jamb members changes, the arched jamb members are utilized that have varying radii of curvature. Heretofore, such variation of arched jamb member curvatures has been accommodated by varying the configurations of the features that support the opposite ends of the arched jamb member which, in turn, accounts for a part of the greater costs of construction of arched jambs over conventional rectangular jambs.

For example, in one prior art arched jamb A as shown in FIG. 1, recesses B are cut in the upper end portions C of the upright jamb members D to receive the opposite ends E of the arched jamb member F. Whenever the radius of curvature "r" of the arched jamb member F and the distance "d" between the upright jamb members D are changed, the angular configuration of the recesses B of the upright jamb members D has to be changed which adds to the overall costs of the arched jambs.

In another prior art arched jamb disclosed in U.S. Pat. No. 6,128,864 to Barry et al., an upper elliptical arched assembly is made of a center arched member and two opposite side members attached to the center arched member. Each of the side members are cut with a taper at both end portions thereof. The side members are cut along respective first and second cut lines that form the tapered end portions. The first cut line is angled along the top portion of the side member such that the top surface of the top end portion of the side member is substantially parallel to the bottom surface of the center arched member when these pieces are attached together. Also, the second cut line is angled along the bottom end portion of the side members such that the top surface of the bottom end portion of the side members is substantially parallel to an inner row of wall studs, or upright members, when attached thereto. So in this prior art arched assembly, three separate pieces with two different radii of curvature are attached to each other to form a single arched assembly. Each side member is configured to transition the radius of curvature of the center arched member into the radius of curvature of each side member which requires different cuts to accommodate different radii of curvature. Thus, the upper arched assembly of this prior art arched jamb would add still further costs rather than reduce costs of arched jambs compared to conventional rectangular jambs.

From the foregoing discussion, it is readily understood that neither of these two prior art arched jambs seem to provide an effective solution of the aforementioned problem. Consequently, a need exists for an innovation which will provides a simple and inexpensive solution to the problem found in prior art arched jamb of an arched wall opening without introducing any new problems in place thereof.

SUMMARY OF THE INVENTION

The present invention provides a standardized arched jamb assembly and construction apparatus and method designed to satisfy the aforementioned need. The arched jamb assembly of the present invention introduces standardization in the sense that cuts made on the opposite ends of an arched jamb member and in the upper end portions of upright jamb members, that form the interfaces there between in the arched jamb assembly, have the same angular configurations, and thus are made standard, irrespective of the curvature of the upper arched jamb member and the horizontal distance between the upright jamb members which is the same as the width of the wall opening defined by the standard arched jamb assembly. The construction apparatus and method of the present invention provide simple and inexpensive tools, techniques and structure for use in constructing the standardized arched jamb assembly.

Accordingly, the present invention is directed to a standardized arched jamb assembly which comprises: (a) an arched jamb member having a pair of opposite ends and first angled cuts made on the opposite ends, the arched jamb member also having a predetermined curvature and radius of curvature; and (b) a pair of opposite upright jamb members having upper end portions and second angled cuts made in the upper end portions which meet and interface with the first angled cuts (notched cuts) on the opposite ends of the arched jamb member so as to assemble the arched jamb member with the upright jamb members to form an arched jamb assembly for defining a wall opening, the first and second angled cuts of the arched jamb member and upright jamb members being comprised of two sides and having substantially identical standard configurations irrespective of variations in the radius of curvature of the upper arched jamb member provided to define wall openings of different widths between the upright jamb members.

The present invention also is directed an apparatus for constructing an arched jamb member for an arched jamb assembly. The apparatus comprises: (a) a fixture having opposite ends and adapted to stationarily hold an arched jamb member such that opposite ends of the arched jamb member (or at least one end) extend outwardly from the opposite ends of the fixture; and (b) cutting means for making an angled cut at each of the opposite ends of the arched jamb member such that an apex is formed by the angled cut that protrudes outwardly from the respective opposite end of the arched jamb member.

The present invention further is directed to a method for constructing an arched jamb assembly which comprises the steps of: (a) making an angled end cut at each of a pair of opposite ends of an arched jamb member such that an apex is formed by the angled cut, preferably a right angle, that protrudes outwardly from the respective one of the opposite ends of the arched jamb member; (b) making an angled notch cut in an inner corner of each of the upper end portions of a pair of upright jamb members such that the angular configurations of the angled end cuts and angled notch cuts are substantially the same; and (c) placing the arched jamb member on the upper end portions of the upright jamb members such that the angled end cuts of the arched jamb member meet and interface with the angled notch cuts of the upright jamb members so as to assemble the arched jamb member with the upright jamb members to form an arched jamb assembly for defining a wall opening.

The present invention further allows for the fabrication of a standardized angled cut for the protrusion of the arched jamb member and notch of the upright jamb members and the standardized location and structure of the notch on the upright jamb members thereby avoiding the custom fabrication of openings depending upon the opening width. Further, the application of these standardized notch and protrusions provides substantial standardization of fabrication techniques.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
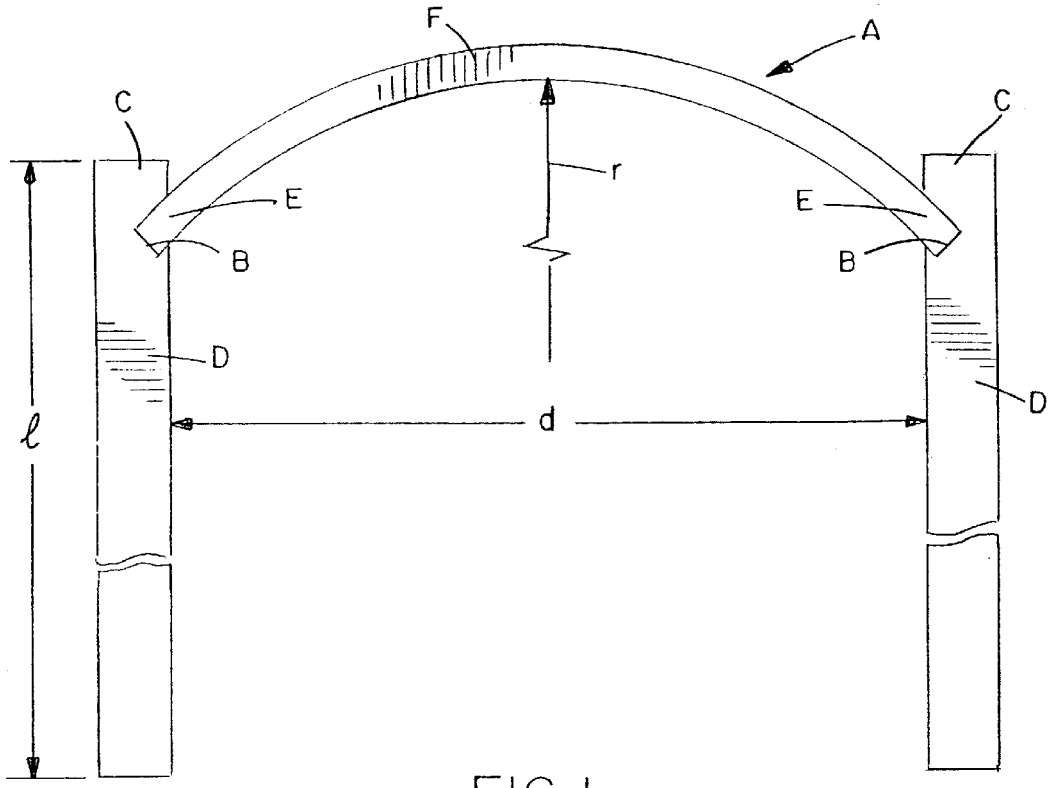
FIG. 1 PRIOR ART
FIG. 1 is a foreshortened front elevational view of a prior art arched jamb assembly.
Figure 2:
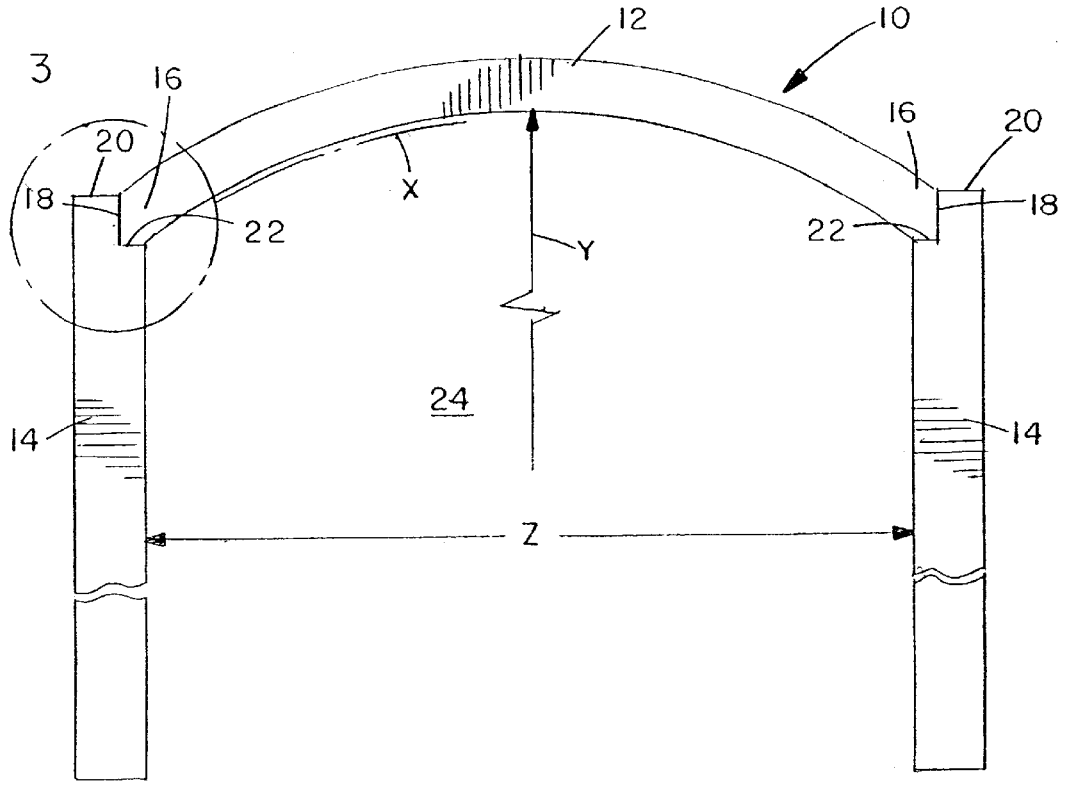
FIG. 2 is a foreshortened front elevational view of a standardized arched jamb assembly of the present invention having an upper arched jamb member and a pair of opposite lateral upright jamb members.

Referring to the drawings and particularly to FIG. 2, there is illustrated a standardized arched jamb assembly of the present invention, generally designated 10. The assembly 10 basically includes an arched jamb member 12 and a pair of opposite upright jamb members 14 of wood, laminant, composite, plastic and/or combinations thereof.

The arched jamb member 12 of the assembly 10 has a pair of opposite ends 16, predetermined curvature "x" and radius of curvature "y", and a pair of first angled cuts 18 each made on one of the opposite ends 16 of the arched jamb member 12. Each upright jamb member 14 of the assembly 10 has an upper end portion 20 and a second angled cut (or notch) 22 made in the upper end portion 20. The first angled cuts 18 of the arched jamb member 12 respectively meet and interface with the second angled cuts 22 of the upright jamb members 14 so as to assemble the arched jamb member 12 with the upright jamb members 14 to form the arched jamb assembly 10 that defines a wall opening 24 below the upper arched jamb member 12 and between the lateral upright jamb members 14 of the assembly 10.

Referring to FIGS. 2 to 5, the angled cuts 18 of the arched jamb member 12 are illustrated in the exemplary embodiment of the assembly 10 as angled end cuts 18 being comprised of two sides 18A, 18B and an apex 18C formed by the intersection of the two sides 18A, 18B that points or protrudes outwardly from the respective opposite ends 16 of the arched jamb member 12. The angled cuts (or notches) 22 of the upright jamb members 14 are illustrated in the exemplary embodiment of the assembly 10 as angled notch cuts 22 made at inner corners 26, shown in dashed outline form, of the upper end portions 20 of the upright jamb members 14, which generally face toward one another, such that inner corners 26 are removed upon formation of the angled notch cuts 22. The angled notch cuts 22 also are comprised of two sides 22A, 22B and an apex 22C formed by the intersection of the two sides 22A, 2B that points or protrudes inwardly into the respective opposite end portions 20 of the upright jamb members 14. The angled end cuts 18 of the arched jamb member 12 and the angled notch cuts 22 of the upright jamb members 14 of the assembly 10 have substantially identical, and thus standardized, angular configurations, irrespective of variations in the curvature "x" and radius of curvature "y" of the upper arched jamb member 12 provided to define wall openings 24 of different widths or distances "z" between the upright jamb members 14.

More particularly, the two sides 18A, 18B of the angled end cuts 18 of the arched jamb member 18 and the two sides 22A, 22B of the angled notch cuts 22 of the upright jamb members 14 are preferably formed at substantially right angles such that, when the arched jamb member 12 and upright jamb members 14 are assembled into the arched jamb assembly 10, a first side 18A, 22A of each of the two-sided angled end cuts 18 and two-sided angled notch cuts 22 are horizontally-oriented, whereas a second side 18B, 22B of each of the two-sided angled end cuts 18 and two-sided angled notch cuts 22 is vertically-oriented. The width "w" of the horizontally-oriented first side 18A, 22A is "maintained constant" whereas the height "h" of the vertically-oriented second side 18B, 22B varies as the curvature "x" and radius of curvature "y" of the upper arched jamb member 12 varies in defining wall openings 24 of different widths and the same standard height. The height "h" of the angled notch cut 22B of the upper jamb member is preferably maintained constant but may vary as the curvature "x" and radius of curvature "y" of the upper arched jamb member 12 varies.

Figure 3:
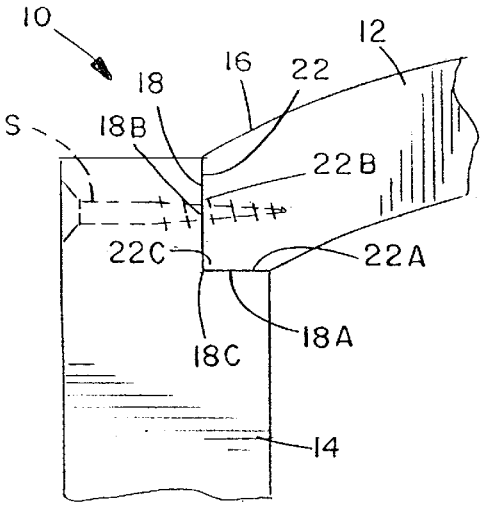
FIG. 3 is an enlarged detailed view of the portion of the arched jamb assembly encompassed by circle 3 of FIG. 2, also showing a fastener securing the upper arched jamb member to one of the upright jamb members of the assembly.
Figure 4:
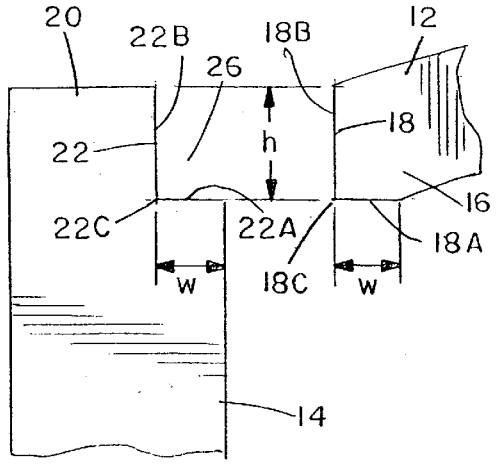
FIG. 4 is a view similar to FIG. 3 but showing the upper arched jamb member and the one upright jamb member in exploded relationship to one another.

The opposite ends 16 of the arched jamb member 12 and the upper end portions 20 of the upright jamb members 14 can be secured together in any suitable manner. One possible way to secure them together is by a conventional screw S, such as seen in FIG. 3. Examples of other suitable alternative ways are by nails, adhesive or pegs.

Figure 5:
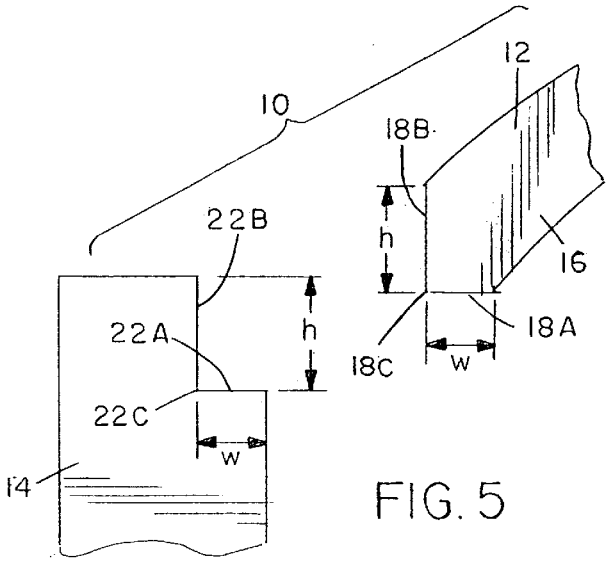
FIG. 5 is a view similar to that of FIG. 3 but showing the upper arched jamb member with a steeper curvature than the upper arched jamb member of FIG. 3 and depicting the greater height of vertically-oriented sides of the angled cuts of the arched jamb member from the steeper curvature of the arched jamb member with the standardized angled cut of the upright jamb member.
Figure 5A:
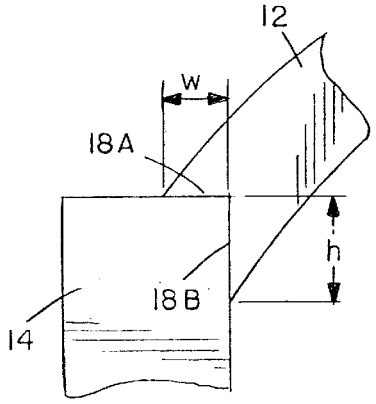
FIG. 5A is a view similar to that of FIG. 3 but showing a notch in the end of the upper arched jamb member and the corner of the upright jamb members forming a protrusion.

Referring to FIG. 5A, there is illustrated an opposite notch-protrusion structures such that the width "w" of the horizontally-oriented first side 18A and 22A is made variable and whereas the height "h" of the vertically-oriented second side 18B is constant as the curvature "x" and radius of curvature "y" of the upper arched member 12 varies. In addition, the width "w" could be made constant while the height "h" is allowed to vary. In these alternatives, however, the notch is provided within the upper arched jamb member 12 and the protrusion is formed by the inside corner of the upright jamb members 14.

Figure 6:
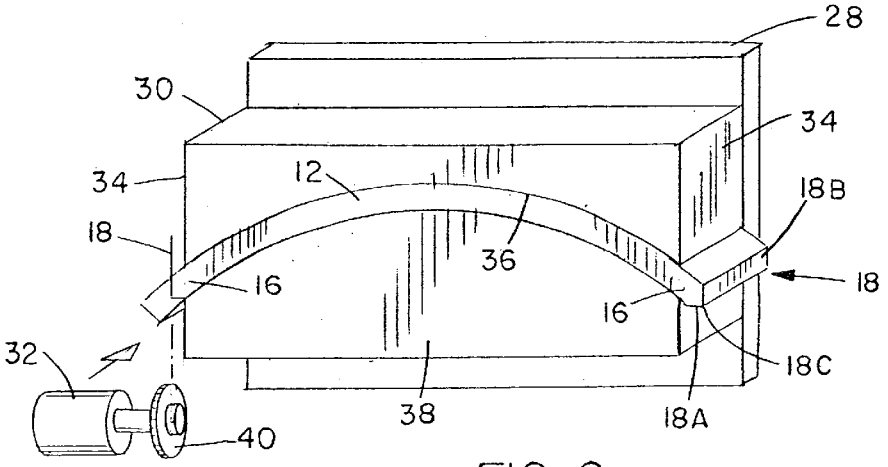
FIG. 6 is a perspective view of an exemplary embodiment of an apparatus for construction of the arched jamb member of the assembly.

Referring to FIG. 6, there is illustrated an apparatus 28 for constructing the arched jamb member 12. The apparatus 28 basically includes a jig or fixture 30 and cutting means 32. The fixture 30 of the apparatus 28 has opposite ends 34 and can have an arcuate shaped slot 36 formed therein being open at a front side 38 of the fixture 30 and extending between the opposite ends 34 thereof. In addition, or as alternatives, to the slot 36, devices such as clamps (not shown) and the like can be employed at the opposite ends 34 of the fixture 30 to hold the arched jamb member 12 adjacent to its opposite ends 16. The slot 36 has the same curvature as the arched jamb member 12 to receive and stationarily hold the arched jamb member 12 such that one or both ends of its opposite ends 16 extend outwardly from and beyond one or both of the opposite ends 34 of the fixture 30, respectively, as seen in FIG. 6.

The cutting means 32 of the apparatus 28 is adapted to make the angled end cut 18 at each of the opposite ends 16 of the arched jamb member 12 such that the apex 18C formed by the angled end cut 18 protrudes outwardly from the respective opposite end 16 of the arched jamb member 12. The cutting means 32 preferably is a cutting tool which per se is conventional, such as one utilizing a dado blade 40, and adapted to make a substantially right-angled cut. The cutting means 32 thus provides the two sides 18A, 18B of each of the angled end cuts 18 with the first side 18A being the horizontally-oriented side and the second side 18B being the vertically-oriented side of the arched jamb member 12 in the assembled arched jamb assembly 10. The cutting means 32 also provides a constant width to the horizontally-oriented first side 18A and a variable height to the vertically-oriented second side 18B which varies as a radius of curvature of the upper arched jamb member 12 varies to define wall openings 24 of different widths. The angled notch cut 22 can be made in the upper end portion 20 of each of the upright jamb member 14 in a conventional manner by using a conventional tool, such as a saw, router or the like, so as to provide an angled notch cut 22 (preferably right angled) identical in configuration to that of the angled end cut 18.

The cutting means 32 of the apparatus 28 may be linked or connected by any conventional means by mechanical linking, pneumatic controls or other conventional means such that the end cut 18 at each of the opposite ends are performed at substantially the same time. Alternatively, the cutting means 32 of the apparatus 28 for each end may be separate such that the end cuts are performed separately. The fixture 30 may be rotated from a first orientation to a second orientation such that only one cutting means 32 is required (not shown). The cutting means 32 may include separate horizontal and vertical cutters that are either linked or independent (not shown).

From the foregoing description of the exemplary embodiments of the arched jamb assembly 10 and construction apparatus 28, the method for constructing the arched jamb assembly 10 preferably has the following steps. An angled end cut 18 is made at each of the opposite ends 16 of the arched jamb member 12 such that the apex 18C formed by the angled end cut 18 protrudes outwardly from the respective one of the opposite ends 16 of the arched jamb member 12. An angled notch cut 22 is made in the inner corner 26 of each of the upper end portions 20 of the upright jamb members 14 such that the width "w" of the angled end cuts 18 and angled notch cuts 22 are substantially the same. The arched jamb member 12 at its opposite ends 16 is placed on the upper end portions 20 of the upright jamb members 14 such that the angled end cuts 18 of the arched jamb member 12 meet and interface with the angled notch cuts 22 of the upright jamb members 14 so as to assemble the arched jamb member 12 with the upright jamb members 14 to form the arched jamb assembly 10 for defining the wall opening 24.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A standardized arched jamb assembly for framing a wall opening, comprising:

(a) an arched jamb member having a pair of opposite ends and first angled cuts made on said opposite ends, said arched jamb member also having opposite front and rear faces facing in opposite directions from a wall opening when installed in said opening, a curved upper edge and a curved lower edge at predetermined curvature and radius of curvature, the arched jamb member being of predetermined thickness between said front and rear faces and being formed continuously along its length between said opposite ends;

(b) a pair of opposite upright jamb members for installing on opposite sides of the wall opening, the upright jamb members having opposite front and rear faces and being of predetermined thickness substantially matching the thickness of the arched jamb member, and having upper end portions and second angled cuts made at said upper end portions which meet and interface with said first angled cuts on said opposite ends of said arched jamb member so as to assemble said arched jamb member with said upright jamb members to form an arched jamb assembly for framing a wall opening, such that the opposite faces of the arched jamb member are substantially flush with the opposite faces of the upright jamb members, said first and second angled cuts of said arched jamb member and upright jamb members being comprised of only two sides and having substantially identical standard angular configurations irrespective of variations in the radius of curvature of said arched jamb member provided to define wall openings of different widths between said upright jamb members.

2. The assembly of claim 1 wherein said two sides of said first and second angled cuts of said arched and upright jamb members are formed at substantially right angles.

3. The assembly of claim 1 wherein said two sides of said second angled cuts of said upright jamb members form a notch which is open at said opposite front and rear faces of each respective upright jamb member.

4. The assembly of claim 3 wherein said two sides of said first angled cuts of said arched jamb member form a protrusion which fits into said notch.

5. The assembly of claim 1 wherein said first and second angled cuts respectively are standard right-angled notches and end cuts.

6. The assembly of claim 1 wherein a first side of said first and second angled cuts is horizontally-oriented and a second side of said first and second angled cuts is vertically-oriented.

7. The assembly of claim 6, including a plurality of different arched jamb members and identical upright jamb members for arched jamb assemblies defining wall openings of different widths, said different arched jamb members each having a different radius of curvature, wherein the width of said horizontally-oriented first side of said first angled cut in each arched jamb member is constant and the height of said vertically-oriented second side of said first angled cut in each arched jamb member varies as said radius of curvature of said upper arched jamb member varies in defining wall openings of different widths, the second angled cuts of said upright jamb members all being of identical dimensions.

8. A standardized arched jamb assembly for defining a wall Opening, comprising:

(a) an arched jamb member having a pair of opposite ends and angled end cuts made on said opposite ends, said arched jamb member also having opposite front and rear faces facing in opposite directions from a wall opening when installed in said opening, and having a predetermined curvature and radius of curvature, the arched jamb member having a curved upper edge and a curved lower edge and being of predetermined thickness between said front and rear faces;

(b) a pair of opposite upright jamb members for installing on opposite sides of the wall opening, the upright jamb members having opposite front and rear faces and being of predetermined thickness substantially matching the thickness of the arched jamb member, and each upright jamb member having an upper end portion with an angled notch cut made therein at an inner corner of said upper end portion such that said angled notch cuts of said upright jamb members generally face toward one another and meet and interface with said angled end cuts on said opposite ends of said arched jamb member so as to assemble said arched jamb member with said upright jamb members to form an arched jamb assembly for framing a wall opening, such that the opposite faces of the arched jamb member are substantially flush with the opposite faces of the upright jamb members, said angled end cuts of said arched jamb member and said angled notch cuts of said upright jamb members have only two sides and are of substantially identical standard angular configurations irrespective of variations in the radius of curvature of said arched jamb member provided to define wall openings of different widths between said upright jamb members.

9. The assembly of claim 8 wherein said two sides of each of said angled end cuts and angled notch cuts form a standard right angle.

10. The assembly of claim 8 wherein a first side of each of said two sides is horizontally oriented and a second side of each of said two sides is vertically oriented.

11. The assembly of claim 10, including a plurality of different arched jamb members for arched jamb assemblies defining wall openings of different widths, said different arched jamb members each having a different radius of curvature, the width of said horizontally-oriented first side of said angled end cut in each arched jamb member is constant and the height of said vertically-oriented second side of said angled end cut in each arched jamb member varies as said radius of curvature of said upper arched jamb member varies in defining wall openings of different widths.

12. An arched wall opening assembly, comprising:

a wall having opposite outer faces and an opening;

the opening having an upper arched end and opposite sides;

an arched jamb member extending across and defining the upper arched end of said wall opening, the arched jamb member having a pair of opposite ends and first angled cuts made on said opposite ends, said arched jamb member being of predetermined curvature and radius of curvature and having a curved upper edge and a curved lower edge; and a pair of opposite upright jamb members extending along and defining opposite sides of said wall opening, the upright jamb members having upper end portions and second angled cuts made at said upper end portions which meet and interface with said first angled cuts on said opposite ends of said arched jamb member so as to assemble said arched jamb member with said upright jamb members to form an arched jamb assembly defining said wall opening, said first and second angled cuts of said arched jamb member and upright jamb members being comprised of only two sides and having substantially identical standard angular configurations irrespective of variations in the radius of curvature of said arched jamb member provided to define wall openings of different widths between said upright jamb members.

* * * * *